United States Patent [19]

Siano

[11] 4,343,457

[45] Aug. 10, 1982

[54] RAIL JACK ADAPTOR

[76] Inventor: James C. Siano, 53 E. Baltimore Pike, Second Flr., Clifton Heights, Pa. 19018

[21] Appl. No.: 196,116

[22] Filed: Oct. 10, 1980

[51] Int. Cl.[3] ..... E01B 29/22

[52] U.S. Cl. ..... 254/43

[58] Field of Search ..... 254/43–44, 254/29 R, 30, 31, 132–133, DIG. 1; 294/118, 16

[56] References Cited

U.S. PATENT DOCUMENTS

| | | | |
|---|---|---|---|
| 317,829 | 5/1885 | Mergenthaler . | |
| 623,300 | 4/1899 | Zetter . | |
| 637,843 | 11/1899 | Zetter . | |
| 961,761 | 6/1910 | Erickson | 294/118 |
| 1,247,224 | 11/1917 | Churchia | 254/44 |
| 1,321,950 | 11/1919 | Templeton | 254/133 R |
| 1,350,970 | 8/1920 | Hutchison et al. | 254/DIG. 1 |
| 1,468,231 | 9/1923 | Goldbeck . | |
| 1,559,910 | 11/1925 | Peterson | 254/133 R |
| 1,646,770 | 10/1927 | Shasteen . | |
| 1,822,409 | 9/1931 | Lawrence . | |
| 1,836,082 | 12/1931 | McManus . | |
| 2,133,851 | 10/1938 | Denton . | |
| 2,219,577 | 10/1939 | Neeley et al. . | |
| 2,806,734 | 9/1957 | Klomp | 294/118 |

*Primary Examiner*—Robert C. Watson

*Attorney, Agent, or Firm*—Woodcock, Washburn, Kurtz, Mackiewicz & Norris

[57] ABSTRACT

A novel rail jack adapter is disclosed for use with a railroad jack having a base for supporting the jack, a generally upright body extending away from that base, a rack longitudinally movable with respect to the jack body (at least the head of which rack is extensible beyond the head of said body), and a pivotal jack handle extending generally away from said body for moving said rack with respect to said body. This adapter permits such a jack to be readily converted for use in removing or replacing damaged or rotted railroad ties. The disclosed adapter eleminates the need to laborously remove or replace such ties by hand, and/or obviates the need for expensive tie-pulling equipment which is dedicated solely to that purpose.

10 Claims, 5 Drawing Figures

RAIL JACK ADAPTOR

BACKGROUND OF THE INVENTION

It has long been known that railroad ties which are worn, damaged or rotted should be removed from and replaced in an existing rail bed. In order to replace such a tie, it is necessary to remove any spikes which hold the tie fixed with respect to its associated rails, remove any ballast, gravel or other debris from the vicinity of at least one end of the ties, if desired jack up the track located over the tie to create additional clearance to permit the removal of the tie, and then longitudinally extract the tie from under the rails.

Over the years, many devices have been suggested for use in extracting railroad ties. For example, in U.S. Pat. No. 317,829 (Mergenthaler), dated May 12, 1885, it was suggested that a tie extractor could be provided consisting of a jawed bearing bar, a beaked rack-bar sliding thereon, a lever link pivoted on the rack-bar, and a gear lever pivoted to the lever-link and engaging the rack/bar. By applying the jaws of the bearing bar over the head of a rail, and piercing the top surface of the underlying tie with the beak formed on the rack-bar, it was possible, through manipulation of the lever and gear mechanism, to cause the translation of the underlying tie with respect to the track.

In concept, the Mergenthaler tie extractor and replacer is similar to a number of devices which were designed to be dedicated solely to the task of extracting and replacing railroad ties. For a description of such devices please refer to U.S. Pat. Nos. 632,300 (Zetter), 637,843 (Zetter), 1,468,231 (Goldbeck), 1,836,082 (McManus), 2,219,577 (Neely et al), 2,133,851 (Denton) and 1,822,409 (Lawrence). In these patents, devices of varying degrees of complexity are disclosed with varying means for engaging one or more of the associated railroad rails, for engaging the tie to be pulled, and for providing a mechanical advantage intended to ease the extraction of the subject tie. These patents suggest various tie or rail engaging configurations including various rail engaging bracket configurations and tie engaging claws and/or tongs. Similarly, various gear rack, rachet, screw and lever configurations have been suggested for providing the aforementioned mechanical advantage.

In spite of the many devices which have been suggested over the years for extracting ties, manually operatable tie removing devices routinely utilized by railway track maintenance crews in this country. In fact, most of the millions of ties which are replaced each year in the United States are replaced entirely by hand, that is, by using picks, shovels, and other simple hand tools to replace such ties. In fact, the only routinely used, hand operated device which provides a substantial mechanical advantage is the standard railway rail jack, which is also commonly referred to as a "track jack". One of such commonly used rail or track jack is illustrated in the FIG. 2 of this application. In FIG. 2 this rail jack (50) is illustrated as comprising an enlongated jack body (58) which terminates in a base (66) having a substantially planer jack support surface defined thereon for supporting the jack in its normal, upright position. This jack body contains a jack rack (60) having a rack head (62) which is disposed for axial movement with respect to body (58). Movement of the jack rack (60) with respect to body (58) is accomplished through pivotal movement of jack handle (52) which acts through jack socket (54) and an internal rachet and gear mechanism to cause a selective extension or retraction of rack (60) and its associated jack lifting tang (64). In normal operation, the rail jack is placed in an upright position on the ground under a rail to be lifted, with lifting tang (64) under that rail, whereupon the jack is used in a conventional manner to raise and lower the rail with respect to the ground.

It has previously been suggested to modify a track jack as to permit that jack to be used both for aligning and leveling rails and for removing and replacing ties and the like. In U.S. Pat. No. 1,646,770 (Shasteen), dated Oct. 25, 1927, a track jack was disclosed having a removable base. In this specialized jack, a longer rack-bar (22) than normal is utilized having a chain hook (23) on one end and a notched head (25) on the other. A tie hook or angular extension of the jack (16) is used to hook over a rail or tie, as shown in the figures. When it is desired to utilize this apparatus as a rail jack, the base (**10*b*) is fitted on the upper portion (10a) so that the bill (24) of chain hook (23**) can act as a lifting surface. Thus, this specialized tie pulling apparatus can be adapted for utilization as a track lifting device.

At the present time, there exists a substantial need to improve the time in which ties may be extracted and replaced during the maintenance of railway track. It may currently take a railway crew about 1½ to 2 man-hours to remove and replace a single tie. Such work is often conducted in the vicinity of train traffic, and even on track which is not entirely out of service. Accordingly, it is important to minimize the amount, size and weight of apparatus to be used at the work site, and to ensure that such apparatus will not substantially interfere with the passage of trains over and through the work area. For these and other reasons, prior art hand operated tie pulling apparatuses have not achieved substantial degrees of commercial success.

SUMMARY OF THE INVENTION

The present invention provides a novel adapter for use with a conventional rail jack which facilitates the use of that rail jack to pull and replace railroad ties. This rail jack adapter comprises a rail bracket means connectable to a railroad rail for receiving the base of said jack to position it over the tie to be pulled, a jack cap connectable to the rack head of the jack, a tie gripping means for selectively gripping the tie to be pulled, and a chain means connected to the tie gripping means for interconnecting the jack rack with the gripping means. Once in place, the adapter-jack assembly is particularly suited for removing ties by utilizing the upwardly extending jack handle. By reason of the mounting and orientation of the adapter-jack assembly, substantially horizontal but slightly uplifting forces are applied to the end of the tie to be pulled without creating undesired torques on the rail upon which the adapter-jack assembly is mounted. This is accomplished by pivotally mounting the adapter-jack assembly on its supporting rail, and by mounting the jack in a position such that the torque inherently applied by the jack handle to the jack body is utilized to create the aforementioned uplifting vector component of the tie pulling force. As a result of the above, it has been found that ties are freely and easily removed from a roadbed in approximately one fourth the time heretofore required for the manual removal of such ties, that is, ½ man-hour.

Accordingly, the primary object as an invention is the provision of a novel adapter for use with a conventional rail jack to provide an adapter-rail jack assembly permitting the rapid extraction and replacement of railroad ties.

This and other objects of the present invention will become apparent from the following more detailed description.

DETAILED DESCRIPTION OF THE DRAWINGS

Figure 1:
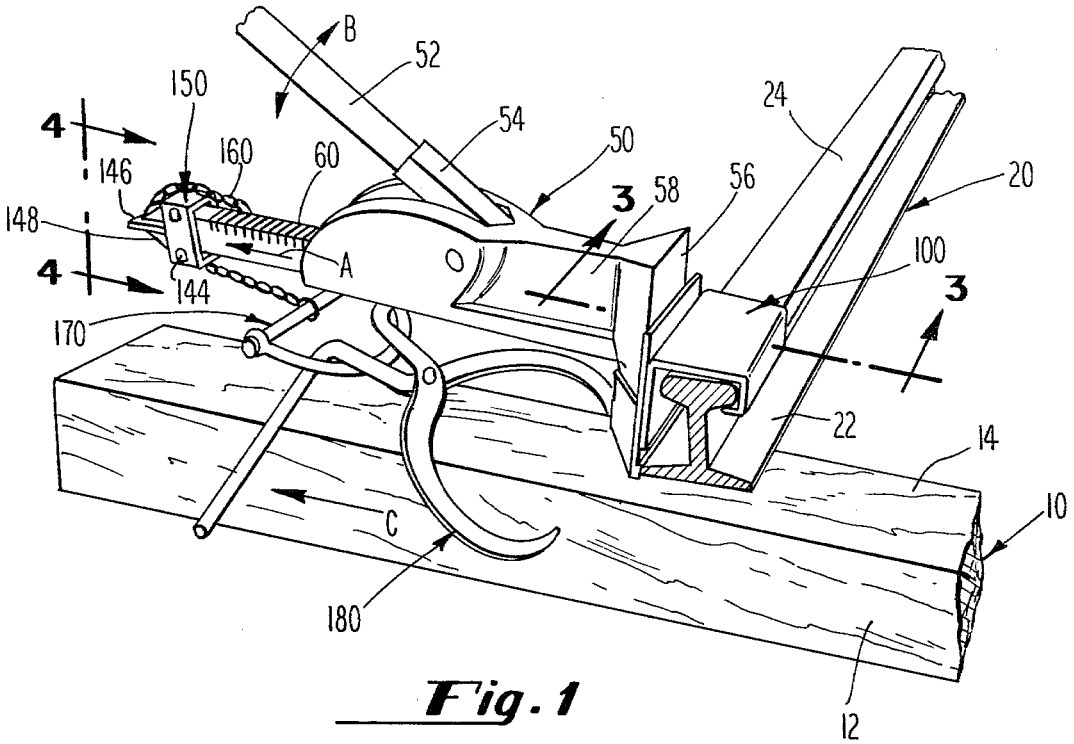
FIG. 1 is a perspective view of an embodiment of the adapter-rail jack assembly of the present invention shown applied over a cross-sectioned railroad rail to remove a foreshortened tie located thereunder.

While specific examples have been illustrated in the drawings and are described in detail hereinafter, one of ordinary skill in the art will recognize that modifications may be made to the embodiments set forth herein without departing from the scope of the present invention, which is defined more fully in the appended claims.

Figure 3:
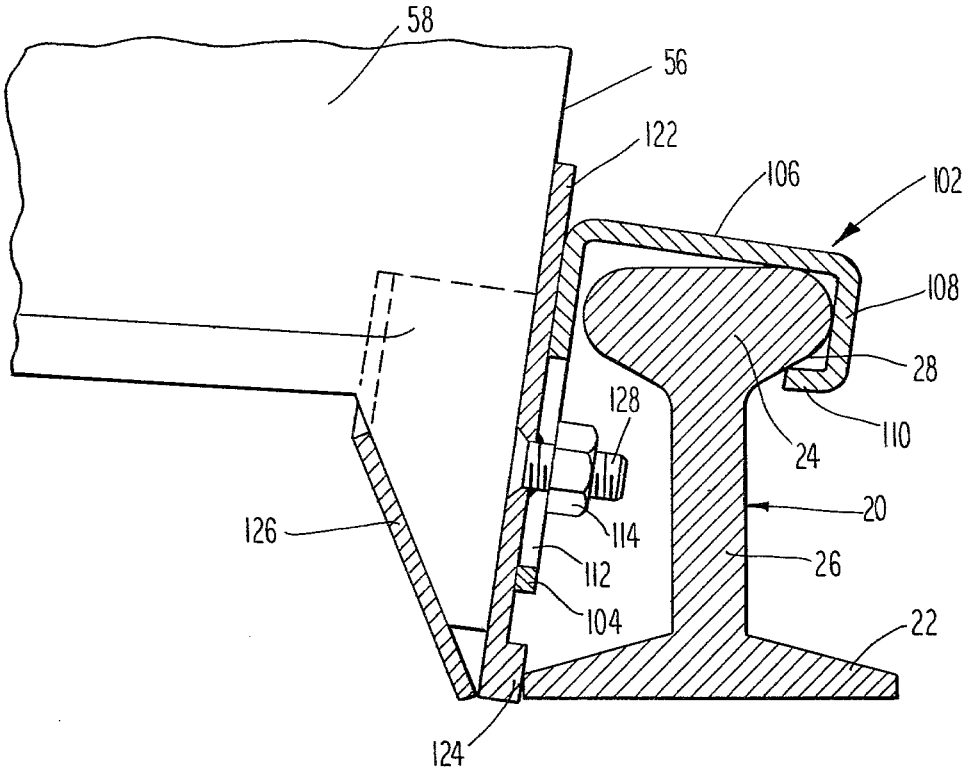
FIG. 3 is an enlarged cross-section of a portion of the adapter-rail jack assembly shown in FIG. 1 taken as indicated by the lines and arrows 3—3 in FIG. 1.

The present adapter is intended for use with a rail jack, as described here and above, and with conventional railroad rails and their associated ties. One such tie, designated generally 10, is illustrated in FIG. 1 and will be seen to have a side tie face (12) and top face (14). In FIGS. 1 and 3, a conventional rail, designated generally 20, comprising a rail base portion (22), rail head (24), rail stem (vertical supporting portion or web) (26) and remote rail head undersurface (28) are illustrated.

As mentioned above, the adapter of the present invention is suited for use with a conventional rail jack, designated generally 50, having a generally enlongated jack body (58) within which translates, in response to pivotal manipulation of jack handle (52) and jack socket (54), a jack rack (60). This jack rack (60) is connected to a jack lifting tang, which in normal use, when the jack support surface (56) of base (66) is placed on the ground, will cause the lifting or lowering of a rail resting on jack lifting tang (64).

Figure 5:
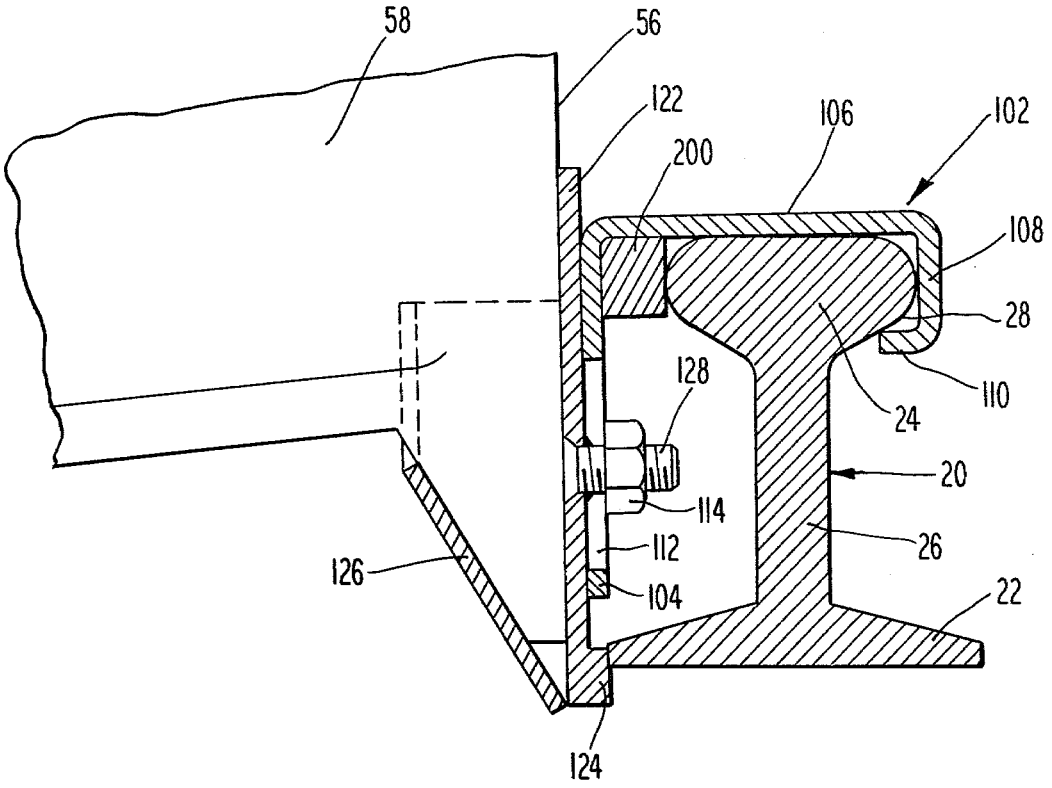
FIG. 5 is a view similar to FIG. 3 showing a preferred embodiment assembly having a rail head bracket with a rail head spacing member interferingly applied over the rail head.

In the preferred embodiment of the present invention, a rail bracket means is provided which is connectable to a railroad rail for receiving the base of said rail jack to position that jack substantially parallel to, over and substantially above a tie to be pulled. This rail bracket means further positions the pivotally connected jack handle so that the jack handle will extend generally vertically away from the tie, and further, so that the direction of jacking force applied through said jack handle (52) will be generally opposite to the direction of intended movement of the tie to be extracted. This bracket receiving means is illustrated in the drawings as a bracket assembly, designated generally 100. The bracket receiving means comprises a rail head bracket, designated generally 102, for engaging the head of the rail, and a jack mount, designated generally 120, which is slidably connected to the rail head bracket and which engages the base of the rail. As seen particularly in FIG. 3, the rail head bracket (102) comprises support plate portion (104), top plate portion (106), head engagement portion (108) and retainer portion (110). Together these portions define a hook shaped cross-section. Retainer portion (110) is sized to engage the remote rail head undersurface (28), while head engagement portion (108) is sized to be slightly shorter than the thickness of rail head (24). The top plate portion (106) is at least as long as the width of rail head (24), and, depending upon the amount of uplifting force desired to be applied to the tie, may be extended to lengths longer than that shown in FIG. 3 so that the jack axis will be oriented within about 15° of being parallel to the tie to be removed. As shown in FIG. 5, the rail head bracket (102) may further comprise a longitudinal spacing member (200) for engaging its associated rail head edge, and to ensure that support plate portion 104 is oriented substantially vertically. In this embodiment, the rail head is interferingly fitted between portions of the rail head bracket.

As mentioned above, the bracket assembly (100) further comprises a jack mount, designated generally 120, having a mounting plate (122), rail base flange (124), jack base retaining flanges (126) and mounting bolts (128). As shown in the figures, mounting plate (122) slidably engages the support plate portion (104) of the rail head bracket so that the bracket assembly may be adjusted to accommodate rail stems (26) of differing dimensions. In this manner, the engagement of rail base flange (124) with the edge of the rail base (22), as shown particularly in FIG. 3, may be assured. Relative adjustment of the rail head bracket and jack mount is accomplished through the use of mounting bolts (128) and nuts (114) which are vertically slidable along adjustment slots (112) defined in the support plate portion (104) of the rail head bracket. When the bracket assembly is to be applied to the rail, retainer portion (110) should first be applied to the undersurface of the rail, and then the unit should be pivoted until the rail base flange (124) of the jack mount comes into engagement with the base of the rail. The jack base retaining flanges (126) of the jack mount are configured to slidingly receive the base (66) of the rail jack and to interferingly engage that jack base in its operating position. In accordance with the preferred embodiment of the present invention, a tie gripping means is provided comprising tong means for engaging opposite outer surfaces of the tie to be moved, and force conversion means for converting at least a portion of the substantially linear tie pulling force applied through the chain into opposing gripping forces applied to the tie surfaces through the tong means. In this manner, gripping forces will automatically increase as tie pulling forces are increased, and conversely, the tie will be released to permit adjustment of the apparatus when the tie is not being pulled. Accordingly, tongs, designated generally 180, having jaws (184), tong stems (186), and elongated, transversely extending tong handles (182) are provided. As shown particularly in FIG. 1, the handles of such tongs should be long enough to permit the tongs to be articulated from either side of the jack assembly which will be oriented thereover during use. A yoke assembly, designated generally 170, is oriented around the center portion of tongs (180). The yoke assembly generally comprises a "C" bar (176), a tie rod (172) spaning between ends of the "C" bar and tie rod nuts (174) threaded on the ends of tie rod (172) to permit removal of the bar, as for example to replace chain (160). As seen particularly in FIG. 1, the yoke is sized to engage flat portions of the tong stems (186), and surfaces of the bases of handles (182), such that, upon application of forces to yoke (170) the configuration of the "C" bar will tend to cause the jaws (184) of the tongs (180) to close upon the tie to be pulled.

Figure 4:
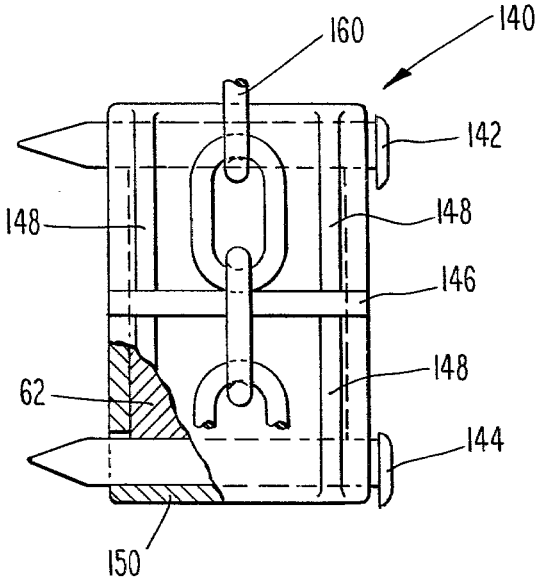
FIG. 4 is an enlarged end-view of a portion of the assembly illustrated in FIG. 1, taken as indicated by the lines and arrows 4—4 in FIG. 1, the lower left hand corner of this illustrated portion being partially broken away in cross-section.

The adapter of the present invention further comprises a jack cap, designated generally 140, which is adapted to be applied over the rack head (62) of jack (50). This jack cap comprises a generally box shaped cap member (150) having disposed on the top thereof chain flange (146) and chain flange supports (148). Chain flange (146) defines a chain slot for receiving a link of chain (160), particularly as shown in FIG. 4. The jack cap is provided with a plurality of spike apertures defined in opposing walls thereof to receive spikes, such as railroad spikes (142 and 144), which may be applied to wedge rack head (62) within cap member (150). Such spikes are, of course, readily available on the job site and thus need not be transported with the remainder of the adapter assembly. The use of a chain slot (152) in the jack cap (140) permits easy adjustment of the interconnection between the jack rack with the tie gripping means regardless of the location of the jack rack (60) or of the tongs (180).

Figure 2:
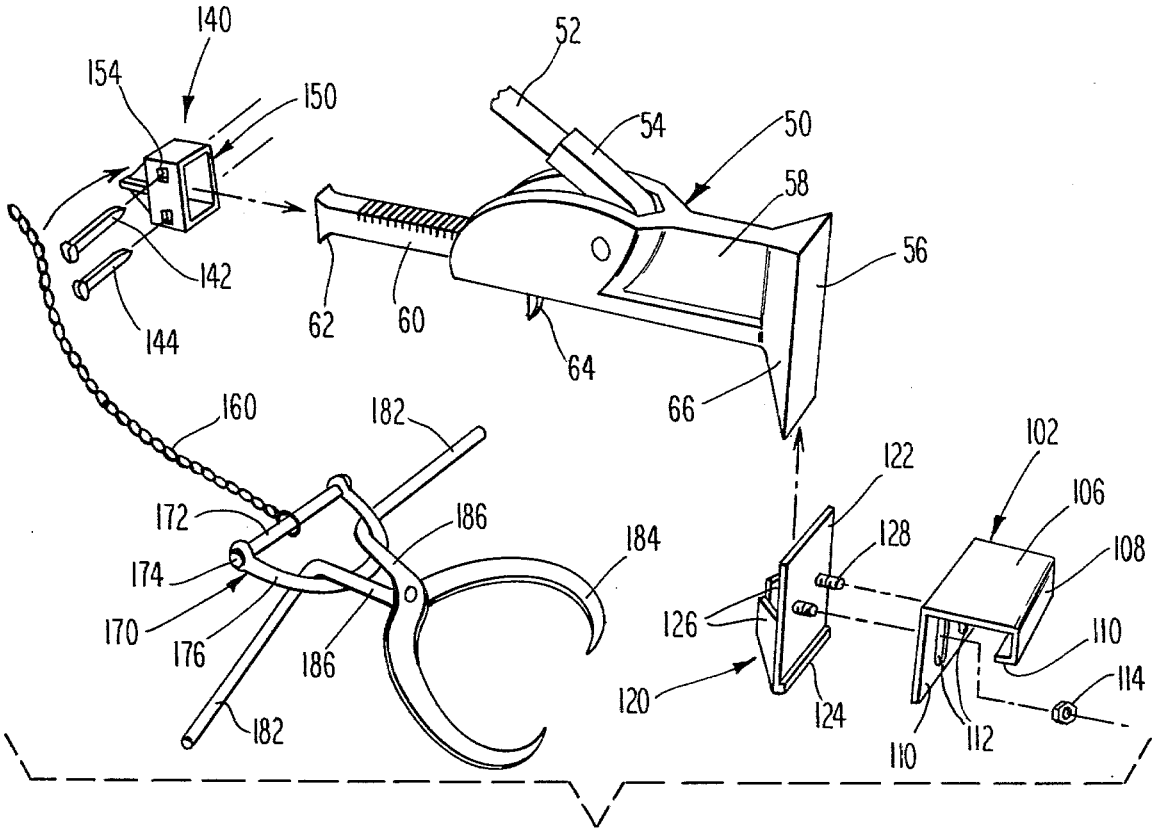
FIG. 2 is an exploded view of the adapter-rail jack assembly illustrated in FIG. 1.

As seen in FIG. 2, the adapter and jack may be easily assembled into the adapter-jack assembly illustrated in FIG. 1. In order to pull a given tie, the assembly may be pivotally applied over the head (24) of rail (20) until the rail base flange (124) comes into contact with rail base (22), whereupon the tongs (180) may be applied to the rail to be pulled and the handle moved in the direction of arrow B in FIG. 1 to cause the jack rack to move in the direction of arrow A to cause the tie to move in the direction of arrow C. Of course, as shown in FIG. 1, the actual force applied to the tie (10) will be along the axis defined by the chain (160), yoke (170) and tongs (180). In the event a train approaches, the jack handle (52) may be manipulated in the direction of arrow B to release tension on the assembly, whereupon the assembly may be quickly removed from rail (20) to permit the train to pass.

While, in the aforementioned description, the adapter-rail jack assembly has been described in terms of extracting a tie, one of ordinary skill in this art will recognize that the adapter-rail jack assembly will be suitable for causing the translation of a tie under a rail in either direction, and thus is also suitable for replacing a tie under such a rail. Further, in the event it is desired to gauge track, the tie gripping means may be replaced with an opposite rail gripping means such as a hook disposed on chain (160), for attachment to an opposite rail to permit relative positioning of adjacent rail tracks.

As seen from the above, a simple, versatile rail jack adapter is provided which exhibits many advantages over devices heretofore known to the art.

What is claimed:

1. A rail jack adapter for use with a rail jack having a base for supporting said jack, a generally upright body extending away from said base, a rack longitudinally movable with respect to said body, at least the head of which rack is extensible beyond the top end of said body, and a pivoted jack handle extending generally away from said body for moving said rack with respect to said body, said adapter facilitating the use of said rail jack to pull railroad ties, said adapter comprising:

(a) rail bracket means connectable to a railroad rail for receiving said base of said jack to position said jack parallel to, over and substantially above a tie to be pulled; and for positioning said pivoted jack handle to extend generally vertically away from said tie;

(b) a jack cap connectable to said rack head;

(c) tie gripping means for selectively gripping a tie to be pulled said tie gripping means comprising tong means for engaging opposite outer surfaces of said tie, and force conversion means for converting at least a portion of the substantially linear tie pulling force applied through said chain means into opposing gripping forces applied to said tie surfaces through said tong means, said tie gripping means comprising pivotally connected tongs having transversely disposed handles thereon, and a yoke around said tongs, said yoke comprising a "C" bar for engaging said tongs and a tie rod bridging said "C" bar, said tie rod being connected to said chain means; and (d) chain means connected to said tie gripping means and selectively connectable along its length to said jack cap for interconnecting said jack rack with said tie gripping means, whereby pivotal movement of said jack handle will cause relative movement of said tie with respect to said base.

2. The invention of claim 1 wherein said bracket receiving means comprises a rail head bracket for engaging the head of said rail; and a jack mount slidably connected to said rail head bracket for engaging the base of said rail.

3. The invention of claim 2 wherein said rail head bracket comprises a retaining portion for engaging at least a portion of the remote undersurface of said rail head.

4. The invention of claim 3 wherein said rail bracket means is connectable to said rail by first engaging said undersurface with said retaining portion and then pivoting said jack mount into engagement with the base of said rail.

5. The invention of claim 4 wherein said rail bracket means comprises plurality of jack base flanges for slidably receiving and interferingly retaining said jack base.

6. The invention of claim 1 wherein jack cap comprises a cap member for application over said rack head, and link engagement means for selective retaining said chain at least during said extension of the rack head.

7. The invention of claim 6 wherein said link engagement means comprises at least one upstanding flange, said flange having a chain-link receiving slot defined therein.

8. The invention of claim 7 wherein said cap member has at least one set of axially aligned aperatures defined therein for receiving at least one railroad spike, said aperatures being oriented such that, upon receipt of said at least one spike, said member is retained on said rack head.

9. The invention of claim 3 wherein said rail head bracket interferingly engages said rail head.

10. The invention of claim 9 wherein said rail head bracket comprises a spacing member for engaging the rail head edge remote from said portion of said rail head engaged by said retaining portion.

* * * * *